US010309413B2

(12) United States Patent
Saito et al.

(10) Patent No.: US 10,309,413 B2
(45) Date of Patent: Jun. 4, 2019

(54) IMPELLER AND ROTATING MACHINE PROVIDED WITH SAME

(71) Applicant: MITSUBISHI HEAVY INDUSTRIES COMPRESSOR CORPORATION, Tokyo (JP)

(72) Inventors: Ryosuke Saito, Tokyo (JP); Shinji Iwamoto, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 399 days.

(21) Appl. No.: 15/106,974

(22) PCT Filed: Aug. 28, 2014

(86) PCT No.: PCT/JP2014/072565
§ 371 (c)(1),
(2) Date: Jun. 21, 2016

(87) PCT Pub. No.: WO2015/107718
PCT Pub. Date: Jul. 23, 2015

(65) Prior Publication Data

US 2017/0037866 A1 Feb. 9, 2017

(30) Foreign Application Priority Data

Jan. 14, 2014 (JP) ..... 2014-004489

(51) Int. Cl.
*F04D 29/30* (2006.01)
*F04D 17/12* (2006.01)
(Continued)

(52) U.S. Cl.
CPC ..... *F04D 29/30* (2013.01); *F04D 17/122* (2013.01); *F04D 29/284* (2013.01);
(Continued)

(58) Field of Classification Search
None
See application file for complete search history.

(56) References Cited

U.S. PATENT DOCUMENTS 5,685,696 A * 11/1997 Zangeneh ..... F01D 5/048 416/186 R
2012/0263599 A1 10/2012 Sugimura et al.

FOREIGN PATENT DOCUMENTS

CN 1156493 A 8/1997
EP 2 020 509 A2 2/2009
(Continued)

OTHER PUBLICATIONS

International Search Report dated Nov. 25, 2014 in Application No. PCT/JP2014/072565.
(Continued)

*Primary Examiner* — Justin D Seabe
*Assistant Examiner* — Juan G Flores
(74) *Attorney, Agent, or Firm* — Birch, Stewart, Kolasch & Birch, LLP

(57) ABSTRACT

An impeller with a disc that rotates about an axis, and blades a plurality of which are disposed in the circumferential direction of the disc with intervals therebetween. A defined blade angle of the blade has a prescribed gradual increase region and gradual decrease region from the center towards the outside, and at the center of an inflection region of the gradual increase region and of the gradual decrease region, provided is a partial gradual decrease region having a smaller blade angle decrease amount than the blade angle increase amount of the gradual increase region.

3 Claims, 5 Drawing Sheets

(51) Int. Cl.
*F04D 29/28* (2006.01)
*F04D 29/42* (2006.01)

(52) U.S. Cl.
CPC ..... *F04D 29/286* (2013.01); *F04D 29/4206* (2013.01); *F05D 2250/713* (2013.01)

(56) References Cited

FOREIGN PATENT DOCUMENTS

| | | | |
|---|---|---|---|
| JP | 10-504621 | A | 5/1998 |
| JP | 2007-9831 | A | 1/2007 |
| JP | 2009-57959 | A | 3/2009 |
| JP | 4888436 | B2 | 2/2012 |
| JP | 2012-219779 | A | 11/2012 |

OTHER PUBLICATIONS

Written Opinion dated Nov. 25, 2014 in Application No. PCT/JP2014/072565.

* cited by examiner

IMPELLER AND ROTATING MACHINE PROVIDED WITH SAME

TECHNICAL FIELD

The present invention relates to an impeller and a rotating machine provided with the same, and particularly, to a technique of making high lift and high efficiency compatible.

Priority is claimed on Japanese Patent Application No. 2014-004489, filed Jan. 14, 2014, the content of which is incorporated herein by reference.

BACKGROUND ART

Rotating machines, such as centrifugal compressors, include impellers provided inside a casing so as to be rotatable relative to the casing. A fluid sucked from the outside of the casing is discharged to a radial outer side of a flow passage within each impeller by rotating the impellers to raise the pressure. In the centrifugal compressors, the shape of each blade provided in the impeller is optimized in order to improve performance.

A technique regarding the shape of such a blade is disclosed in, for example, PTL 1. In a centrifugal compressor of PTL 1, the distribution of the blade angle of the blade is specified in consideration of the flow passage area between blades.

CITATION LIST

Patent Literature

[PTL 1] Japanese Unexamined Patent Application Publication No. 2009-57959

SUMMARY OF INVENTION

Technical Problem

Meanwhile, high efficiency along with a high lift is required in the rotating machines, such as a centrifugal compressor.

Also in the rotating machine of PTL 1, it is difficult to make a high lift and high efficiency compatible with each other at a satisfactory level. In the related art, a suitable technique that can solve this is not present as well.

The invention provides an impeller and a rotating machine provided with the same that can make a high lift and high efficiency compatible with each other.

Solution to Problem

The present inventor has performed a through research regarding high efficiency of an impeller, consequently found that, in the related art, a blade angle is formed in consideration of the flow passage area between blades as in PTL 1, but that it is effective to form the blade angle in consideration of the suppression of a secondary flow in order to make a high lift and high efficiency compatible with each other, and has completed the invention.

Namely, an impeller related to a first aspect of the invention includes a disc; and a plurality of blades. A flow passage is formed between the blades, and a fluid is delivered radially outward from a rotation center along each of the blades by the rotation of the disc. In a case where an angle formed on a backward side in a rotational direction of the disc and an outer peripheral side of the disc among angles formed between a tangent line to a projection curve line obtained by projecting a center curve line of the thickness of the blade onto the disc from the direction of the axis of the rotating shaft and an imaginary line orthogonal to a straight line connecting a tangent point between the projection curve line and the tangent line is defined as a blade angle, then the blade angle of the blade has a predetermined gradual increase region and a gradual decrease region from the center towards the outside, and a partial gradual decrease region having a smaller blade angle decrease amount than the blade angle increase amount of the gradual increase region is provided at the center of an inflection region between the gradual increase region and the gradual decrease region.

The disc is supported by the rotating shaft and rotates about the axis of the rotating shaft.

The plurality of blades are provided to lie substantially in a radial direction on the disc.

In such an impeller, even if a load is stepwisely applied to a fluid in the gradual increase region in order to obtain a high lift, it is possible to reduce the load in the partial gradual decrease region first in the middle of the gradual increase region. Accordingly, the curling tendency of the secondary flow can be markedly suppressed while raising the load. For this reason, it is possible to markedly reduce an energy loss caused by the secondary flow and the main flow interfering with each other.

Moreover, a difference in the angle between the partial gradual decrease region and the subsequent region can be made small by making the blade angle decrease amount of the partial gradual decrease region smaller than the blade angle increase amount of the gradual increase region. Accordingly, it is possible to markedly suppress the curling tendency of the secondary flow, in contrast to a case where the decrease amount of the partial gradual decrease region is made greater than the blade angle increase amount of the gradual increase region. For this reason, it is possible to more markedly reduce an energy loss caused by the secondary flow and the main flow interfering with each other.

In the above impeller, a partial gradual increase region may be provided between the partial gradual decrease region and the gradual decrease region.

In such an impeller, it is possible to more smoothly connect the partial gradual decrease region with the gradual decrease region by providing the partial gradual increase region between the partial gradual decrease region and the gradual decrease region as mentioned above. Accordingly, it is possible to more markedly reduce the curling of the secondary flow. For this reason, it is possible to more markedly reduce an energy loss caused by the secondary flow and the main flow interfering with each other.

In the above impeller, in the blade, in a case where the flow-direction position of a leading edge that is an inlet side into which a fluid flows is 0%, and the flow-direction position of a trailing edge that is an outlet side from which the fluid flows out is 100%, the partial gradual decrease region may be formed within a range of 20% or more and 50% or less.

In such an impeller, it is possible to more appropriately arrange the partial gradual decrease region at a position where the curling of the secondary flow begins to occur. For this reason, it is possible to more reliably suppress the curling tendency of the secondary flow, as compared to a case where the arrangement position of the partial gradual decrease region is not taken into consideration.

In the above impeller, the blade angle of the blade may be a blade angle on a hub side of the blade.

In such an impeller, since it is possible to additionally apply a high load to a fluid on the hub side of the blade by using the blade angle on the hub side of the blade as the blade angle of the blade as mentioned above, a higher lift can be obtained.

Namely, if a high load is applied to a fluid on the hub side of the blade in a case where the partial gradual decrease region is not taken into consideration, the curling tendency of the secondary flow that faces the shroud side from the hub side of the blade becomes strong. Thus, it is difficult to obtain a higher lift.

In contrast, in the above impeller, the blade is provided with the partial gradual decrease region. Thus, the curling tendency of the secondary flow can be markedly suppressed in the partial gradual decrease region while additionally applying a high load to a fluid on the hub side of the blade. Accordingly, it is possible to obtain a higher lift.

Additionally, a rotating machine related to a second aspect of the invention includes a rotating shaft that extends along an axis; and the above impeller that is supported by the rotating shaft, rotates around the axis together with the rotating shaft, and delivers a fluid radially outward from a rotation center by the rotation thereof.

Since the above rotating machine includes the above impeller, it is possible to enhance the efficiency of the rotating machine and increase a lift.

Advantageous Effects of Invention

According to the above impeller and the rotating machine provided with the same, the compatibility between a high lift and high efficiency can be achieved, which was extremely difficult.

DESCRIPTION OF EMBODIMENTS

The invention is characterized by including an impeller that makes a high lift and high efficiency compatible.

Hereinafter, a centrifugal compressor provided with an impeller related to an embodiment of the invention will be described with reference to FIGS. 1 to 5.

Figure 1:
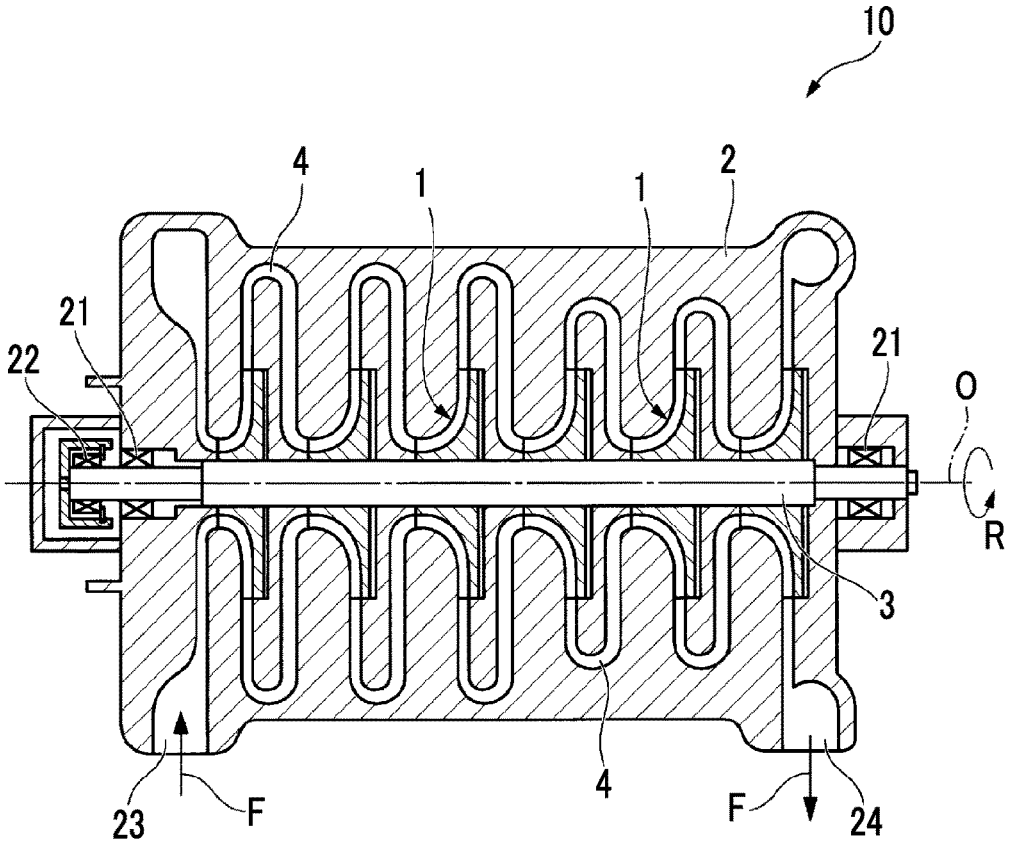
FIG. 1 is a sectional view illustrating the structure of a centrifugal compressor in an embodiment of the invention.

A rotating machine related to the present embodiment is a centrifugal compressor 10, and is a multistage compressor in the present embodiment. As illustrated in FIG. 1, the centrifugal compressor 10 mainly includes a casing 2, a rotating shaft 3 that extends about an axis O arranged so as to pass through the casing 2, and a plurality of impellers 1 that are integrally rotatably fixed to the rotating shaft 3 via a key.

The casing 2 is formed so as to have a substantially columnar contour. The rotating shaft 3 is arranged so as to pass through the center of the casing 2. Journal bearings 21 are provided at both ends of the casing 2 in the direction of an axis O that is a direction in which the axis O of the rotating shaft 3 extends, and a thrust bearing 22 is provided at one end of the casing.

A suction port 23 into which a fluid F, such as gas, is made to flow from the outside is provided at an end on one side (the left side of FIG. 1 on the page) of the casing 2 in the direction of the axis O. A discharge port 24 to which the fluid F is discharged to the outside is provided at an end on the other side (the right side of FIG. 1 on the page) of the casing 2. An internal space, which communicates with the suction port 23 and the discharge port 24, respectively, and in which diameter reduction and diameter increase are repeated, is provided in the casing 2. The impellers 1 are housed in this internal space. Casing flow passages 4 through which the fluid F flowing between the impellers 1 is made to flow from an upstream side to a downstream side are formed at positions between the impellers 1 when the impellers 1 are housed. The suction port 23 and the discharge port 24 communicate with each other via the impellers 1 and the casing flow passages 4.

The rotating shaft 3 has the impellers 1 housed in the casing 2 externally fitted thereto, and rotates about the axis O together with the impellers. The rotating shaft 3 is supported by the journal bearings 21 and the thrust bearing 22 so as to be rotatable with respect to the casing 2, and is rotated by a prime mover (not illustrated).

Figure 2:
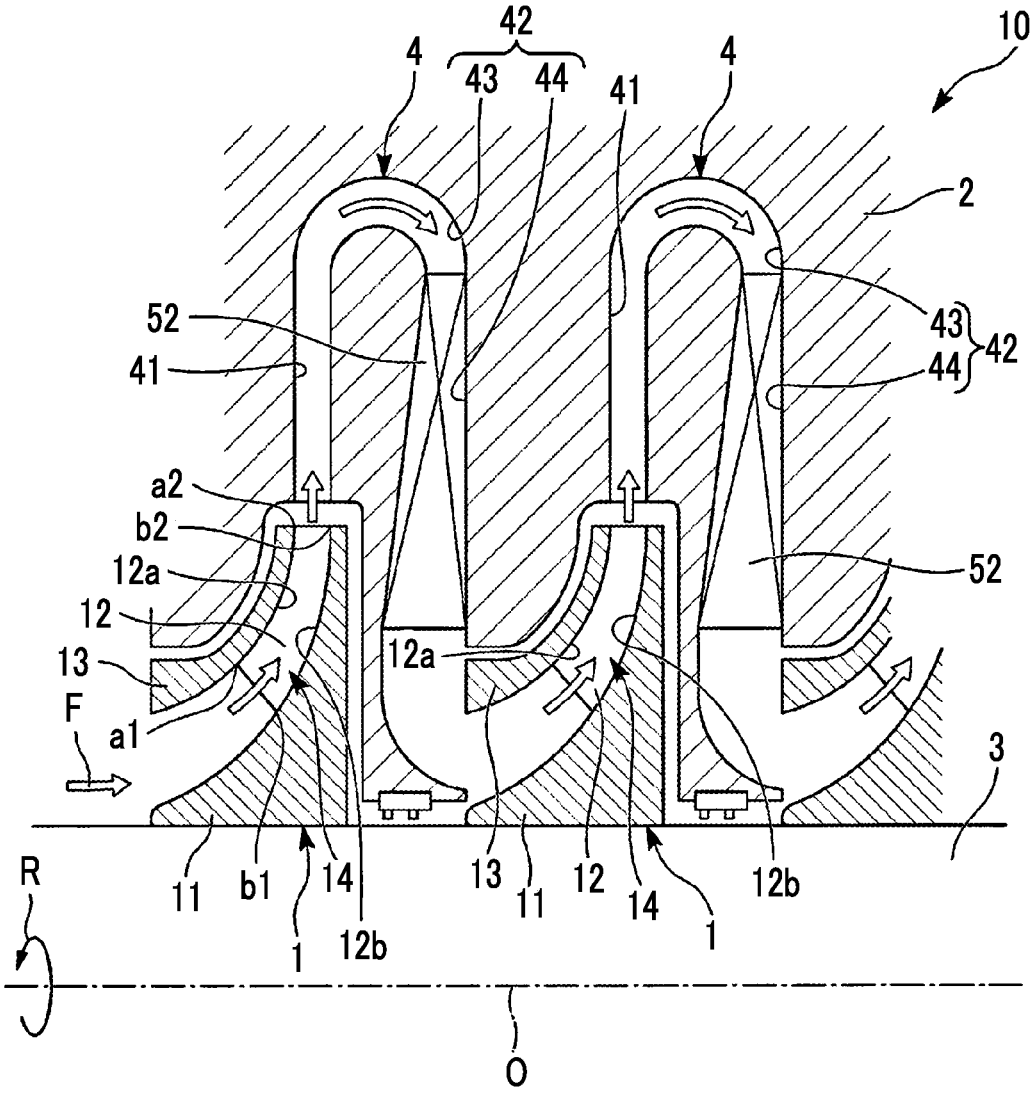
FIG. 2 is a sectional view of main parts illustrating the structure of the centrifugal compressor in the embodiment of the invention.

As illustrated in FIG. 2, the plurality of impellers 1 are arrayed and housed at intervals, in the direction of the axis O that is the direction in which the axis O of the rotating shaft 3 extends, inside the casing 2.

Each impeller 1 has a substantially disc-shaped disc 11 that is gradually increased in diameter as the impeller becomes closer to an outflow side, and a plurality of blades 12 that are radially attached to the disc 11 and lined up in a circumferential direction so as to rise from the surface of the disc 11 toward one side of the axis O of the rotating shaft 3. The impeller 1 has a cover 13 that is attached so as to cover the plurality of blades 12 in the circumferential direction from one side in the direction of the axis O. A gap is defined between the cover 13 and the casing 2 so that the impeller 1 and the casing 2 do not come into contact with each other.

A flow passage 14 that is a space defined so that the fluid F flows in a radial direction is defined in the impeller 1. The flow passage 14 is defined by, together with two surfaces of a pair of blades 12 adjacent to each other, the surfaces of the disc 11 and the cover 13 provided on both sides in the direction of the axis O of each blade 12. The flow passage 14 allows the fluid F to be sucked and discharged therethrough when each blade 12 rotates integrally with the disc 11. Specifically, the flow passage 14 allows the fluid F to be sucked therethrough, with one side in the direction of the axis O in each blade 12, that is, a radial inner side as an inlet into which the fluid F flows, and the flow passage 14 guides the fluid F and allows the fluid F (the fluid F flowing through the flow passage) to be discharged therethrough, with a radial outer side as an outlet from which the fluid F flows out.

In the disc 11, an end surface that faces one side in the direction of the axis O is formed to have a smaller diameter, and an end surface that faces the other side is formed to have a larger diameter. Also, in the disc 11, these two end surfaces are gradually increased in diameter from one side in the direction of the axis O toward the other side. Namely, the disc 11 has substantially a disc shape when seen from the direction of the axis O, and has substantially an umbrella shape as a whole.

Additionally, a through-hole that passes through the disc 11 in the direction of the axis O is formed on the radial inner side of the disc 11. By the rotating shaft 3 being inserted and fitted into this through-hole, the impeller 1 is fixed to the rotating shaft 3, and is made rotatable integrally with the rotating shaft 3.

The cover 13 is a member that is provided integrally with the plurality of blades 12 so as to cover the blades from one side in the direction of the axis O. The cover 13 has substantially an umbrella shape that is gradually increased in diameter from one side in the direction of the axis O toward the other side. Namely, in the present embodiment, the impeller 1 is a closed impeller having the cover 13.

Figure 3:
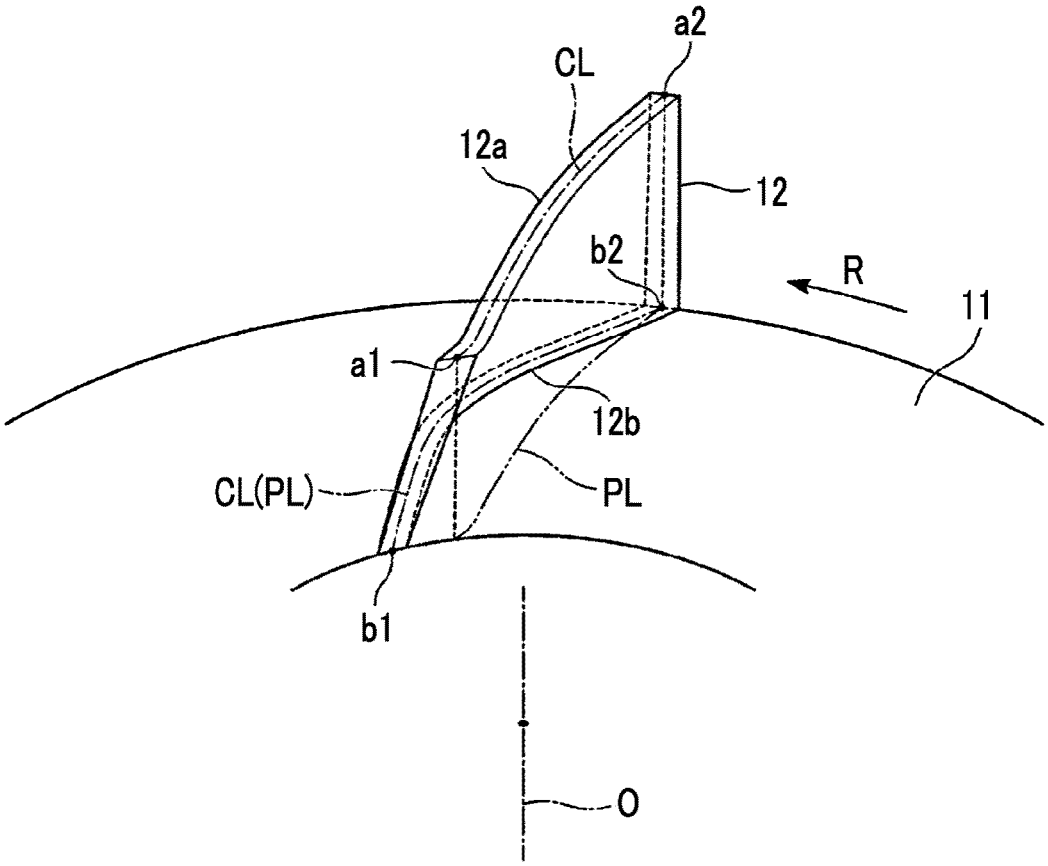
FIG. 3 is a schematic view illustrating the shape of a blade of an impeller in the embodiment of the invention.

The plurality of blades 12 are arranged at regular intervals in the circumferential direction R of the axis O, that is, in a rotational direction so as to rise from the disc 11 toward the cover 13 on one side in the direction of the axis O around the axis O. Here, a root end of each blade 12 that is located on the disc 11 side and connected to the disc 11 is referred as a hub 12*b*, and a distal end of the blade 12 that is located on the cover 13 side (shroud side) is referred to as a tip 12*a*. As illustrated in FIG. 3, each blade 12 is formed in three dimensions so as to be curved toward a backward side in the rotational direction R from the radial inner side of the disc 11 to the radial outer side. The cover 13 is omitted in FIG. 3.

Figure 4:
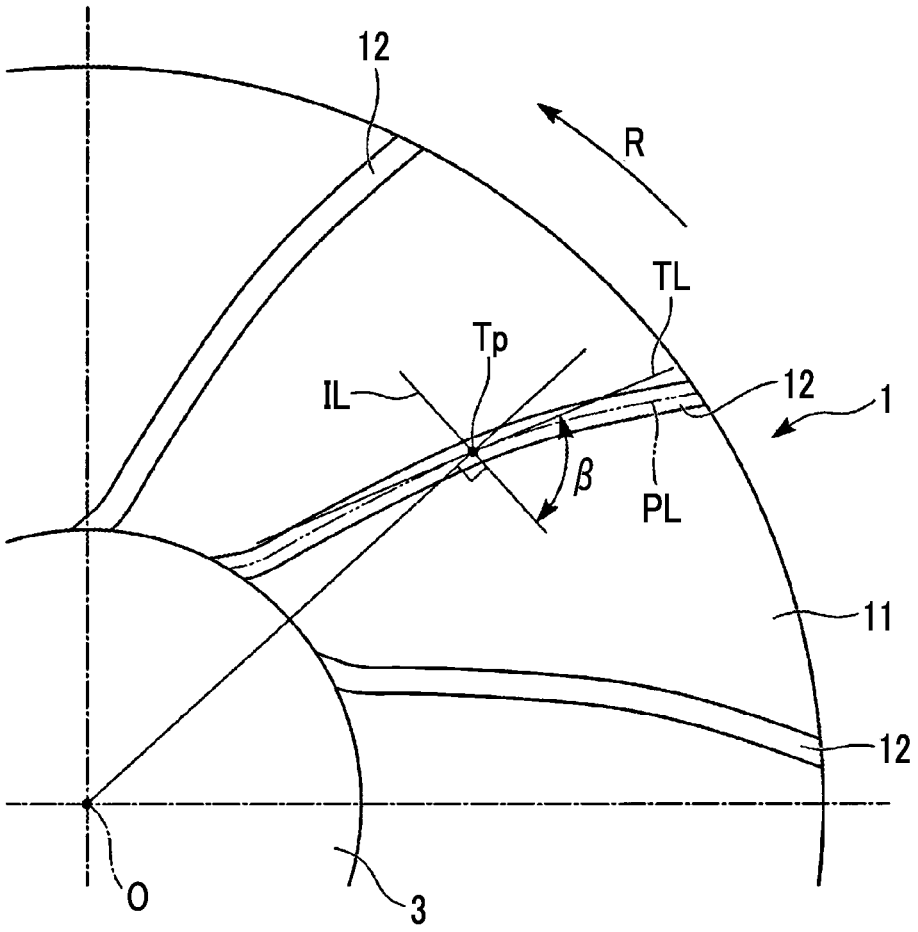
FIG. 4 is a schematic view that defines the blade angle of the blade of the impeller in the embodiment of the invention.

A blade angle β is an angle that determines the curved surface shape of the blade 12 from the inlet (one side in the direction of the axis O) into which the fluid F of the blade 12 flows to the outlet (the radial outer side in the direction of the axis O) from which the fluid F flows out. Specifically, the blade angle β, as illustrated in FIGS. 3 and 4, is derived by projecting a center curve line CL, which is an imaginary curve line drawn by connecting midpoints of the blade 12 in a thickness direction, onto the disc 11 from one side in the direction of the axis O to draw a projection curve line PL, in the tip 12*a* and the hub 12*b* on the shroud side. Namely, an angle formed on the backward side in the rotational direction R of the disc 11 and an outer peripheral side of the disc 11 among angles formed between a tangent line TL to the projection curve line PL, and an imaginary line IL orthogonal to a straight line connecting a tangent point Tp between the projection curve line PL and the tangent line TL, and the axis O is defined as the blade angle β. In the present embodiment, the blade angle of the hub 12*b* of the blade 12 is defined as the blade angle β.

Figure 5:
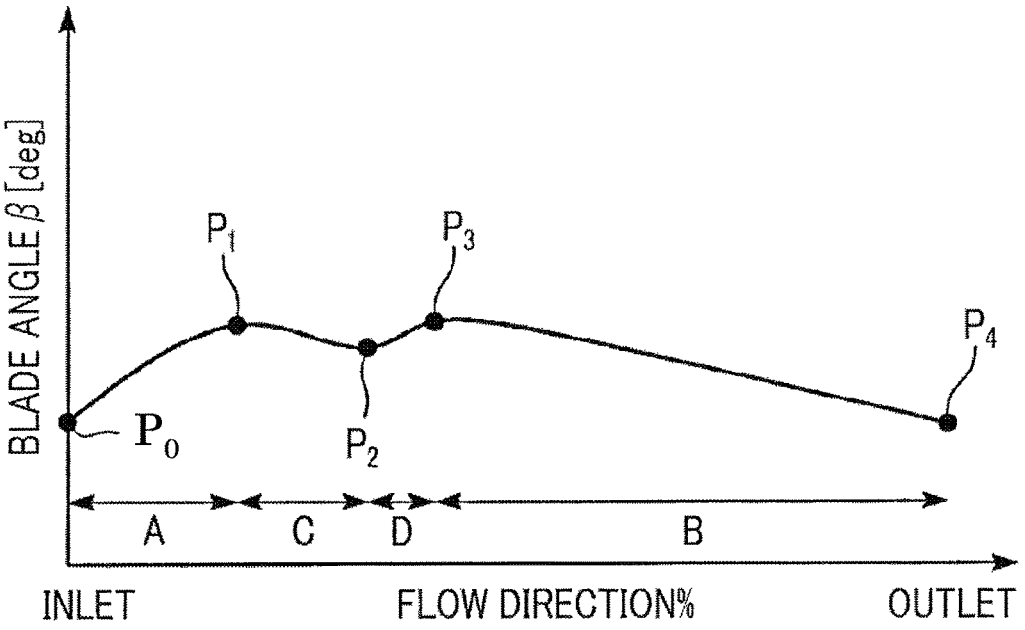
FIG. 5 illustrates the distribution of the blade angle of the blade of the impeller in the embodiment of the invention.

Also, the distribution of the blade angle β of the hub 12*b* of the blade 12 is illustrated in FIG. 5.

A gradual increase region A where the blade angle β becomes gradually larger from an inlet side (a leading edge of the blade 12) toward an outlet side (a trailing edge of the blade 12), and a gradual decrease region B where the blade angle β becomes gradually smaller toward the outlet side are formed in the hub 12*b* of the blade 12.

In the hub 12*b* of the blade, a partial gradual decrease region C having a smaller decrease amount than the blade angle increase amount of the gradual increase region A is formed at the center of an inflection region between the gradual increase region A and the gradual decrease region B.

A partial gradual increase region D where the blade angle β becomes gradually larger toward the outlet side is formed between the partial gradual decrease region C and the gradual decrease region B in the hub 12*b* of the blade 12.

The hub 12*b* of the blade 12 has a first maximum point that is a position $P_1$ where the blade angle β reaches the maximum, a minimum point that is a position $P_2$ where the blade angle β reaches the minimum, and a second maximum point that is a position $P_3$ where the blade angle β reaches the maximum, in order from the inlet side to the outlet side.

In the hub 12*b* of the blade 12, in a case where the flow-direction position of the leading edge that is the inlet side into which a fluid flows is 0%, and the flow-direction position of the trailing edge that is the outlet side from which the fluid flows out is 100%, the partial gradual decrease region C is formed within a range of 20% or more and 50% or less.

Additionally, the above-described casing flow passages 4 are formed so that the pressure of the fluid F is stepwisely raised by connecting the respective impellers 1 together. The suction port 23 is connected to the inlet of an impeller 1 in a forefront stage provided at the end on one side in the direction of the axis O, and the outlet of each impeller 1 is connected to the inlet of the adjacent impeller 1 via each casing flow passage 4. Additionally, the outlet of an impeller 1 in a final stage provided at the end on the other side in the direction of the axis O is connected to the discharge port 24.

The casing flow passage 4 has a diffuser flow passage 41 into which the fluid F is introduced from a flow passage 14, and a return flow passage 42 into which the fluid F is introduced from the diffuser flow passage 41.

The diffuser flow passage 41 communicates with the flow passage 14 on the radial inner side, and allows the fluid F raised in pressure by an impeller 1 to flow radially outward therethrough.

The return flow passage 42 communicates with the diffuser flow passage 41 on one end side thereof, and communicates with the inlet of another impeller 1 on the other end side thereof. The return flow passage 42 has a corner part 43 that reverses the direction of the fluid F, which has flowed radially outward through the diffuser flow passage 41, so as to be directed to the radial inner side, and a straight part 44 that extends radially inward from the radial outer side.

The straight part 44 is a flow passage 14 that is surrounded by a downstream side wall of a partition wall member integrally attached to the casing 2, and an upstream side wall of an extending part that is integrally attached to the casing 2 and extends radially inward. Additionally, the straight part 44 is provided with a plurality of return vanes 52 that are arranged at equal intervals in the circumferential direction around the axis O of the rotating shaft 3.

Next, the operation of the centrifugal compressor 10 that is the rotating machine including the impellers 1 having the above configuration will be described.

In the centrifugal compressor 10 as described above, the fluid F that has flowed in from the suction port 23 flows into the flow passage 14, the diffuser flow passage 41, and the return flow passage 42 of an impeller 1 in a second stage, in the order listed above after flowing through the flow passage 14, the diffuser flow passage 41, and the return flow passage 42 of an impeller 1 in a first stage, in the order listed above.

The fluid F that has flowed to the diffuser passage of the impeller 1 in the final stage flows out from the discharge port 24 to the outside.

While the fluid F flows in the aforementioend order, the fluid F is compressed by the respective impellers 1. Namely, in the centrifugal compressor 10 of the present embodiment, the fluid F is stepwisely compressed by the plurality of impellers 1 so that a large compression ratio is obtained.

Here, in a related-art impeller, a blade angle from an inlet of the impeller to an outlet thereof is formed in consideration of the flow passage area between blades. For this reason, there is a limitation on the compression of a fluid, and it is difficult to obtain a higher lift. Namely, in a case where the related-art impeller is used, a secondary flow is easily generated if the compression of a fluid is increased in order to obtain a lift. If the secondary flow and a main flow interfere with each other, an energy loss occurs, which has a negative influence on efficiency and a pressure rise.

In the related-art impeller, it is also considered that the pressure to be applied to a fluid is lowered in order to raise efficiency. However, a high lift cannot be obtained.

In a case where the related-art impeller is used in this way, it is difficult to realize a high lift and high efficiency at satisfactory and high level.

In contrast, in the present embodiment, in order to realize a high lift and high efficiency at a higher level, in consideration of the suppression of the secondary flow, there is applied a load distribution such that the secondary flow that faces the shroud side from the hub side is reduced while giving a high load to a fluid so as to obtain a lift also on the hub side of the blade.

For this reason, the hub 12*b* of the blade 12 of the present embodiment has the predetermined gradual increase region A and the predetermined gradual decrease region B where the blade angle β increases and decreases outward from the center, and the partial gradual decrease region C having a smaller blade angle decrease amount than the blade angle increase amount of the gradual increase region A is provided at the center of the inflection region between the gradual increase region A and the gradual decrease region B. For this reason, even if a load is gradually raised in the gradual increase region A in order to obtain a high lift, it is possible to reduce the load in the partial gradual decrease region C first in the middle of the gradual increase region. Accordingly, the curling tendency of the secondary flow can be favorably suppressed while raising the load to be applied to a fluid. For this reason, an energy loss caused by the secondary flow and the main flow interfering with each other can be markedly reduced.

Moreover, the blade angle decrease amount of the partial gradual decrease region C is made smaller than the blade angle increase amount of the gradual increase region A. For this reason, a difference in the angle between the partial gradual decrease region C and the subsequent region can be made small. Accordingly, it is possible to markedly suppress the curling tendency of the secondary flow, as compared to a case where the decrease amount of the partial gradual decrease region C is made greater than the blade angle increase amount of the gradual increase region. For this reason, an energy loss caused by the secondary flow and the main flow interfering with each other can be more markedly reduced.

Additionally, the partial gradual increase region D is formed between the partial gradual decrease region C and the gradual decrease region B in the hub 12*b* of the blade 12. Therefore, it is possible to more smoothly connect the partial gradual decrease region C with the gradual decrease region B. Accordingly, it is possible to more markedly reduce the curling of the secondary flow. For this reason, an energy loss caused by the secondary flow and the main flow interfering with each other can be more markedly reduced.

Additionally, in the hub 12*b* of the blade 12, in a case where the flow-direction position of the leading edge that is the inlet side into which a fluid flows is 0%, and the flow-direction position of the trailing edge that is the outlet side from which the fluid flows out is 100%, the partial gradual decrease region C is formed within a range of 20% or more and 50% or less. Therefore, the partial gradual decrease region C can be more appropriately arranged at a position where the curling of the secondary flow begins to occur. As a result, it is possible to more reliably suppress the curling tendency of the secondary flow, as compared to a case where the position of the partial gradual decrease region C is not taken into consideration.

Since the blade angle β of the hub 12*b* can be taken into consideration in the blade 12, and the load to be applied to a fluid can be increased also on the hub 12*b* side, a higher lift can be obtained.

Namely, if a high load is applied to a fluid on the hub side of the blade in a case where the partial gradual decrease region C is not taken into consideration, the curling tendency of the secondary flow that faces the shroud side from the hub side of the blade becomes strong and it becomes difficult to increase the load to the fluid on the hub side of the blade. Thus, it is difficult to obtain a higher lift.

In contrast, in the impeller 1 related to the present embodiment, the blade 12 is provided with the partial gradual decrease region C in consideration of the blade angle β of the hub 12*b*. Thus, the curling tendency of the secondary flow can be markedly suppressed in the partial gradual decrease region C while applying a high load to a fluid also on the hub 12*b* side of the blade 12. For this reason, since a higher load can be applied to a fluid also on the hub 12*b* side of the blade 12, a higher lift can be obtained.

As described above, the impeller 1 of the present embodiment allows the load distribution such that the secondary flow that faces the shroud side from the hub 12*b* side of the blade 12 is reduced while applying a high load to a fluid so as to obtain a lift also on the hub 12*b* side of the blade 12. Namely, in the distribution of the blade angle β on the hub side of the blade as illustrated in FIG. 5, two maximum points and one minimum point are provided while making the blade angles on the shroud side at the leading edge equal to each other.

More specifically, in FIG. 5, loss is reduced at a position $P_0$ by making an inlet load small.

In FIG. 5, at a position $P_1$, a load is increased also on the forward side in the flow direction by providing a first maximum point.

In FIG. 5, at a position $P_2$, it is usually considered that the curling of the secondary flow begins to occur.

Thus, in the present embodiment, the minimum point is provided at the position $P_2$ where the curling of the secondary flow begins to occur. Namely, a low load is used at the position $P_2$, and occurrence of the curling of the secondary flow is efficiently suppressed.

The position $P_2$ of the minimum point is within a range of 20% and 50% from the inlet (the leading edge of the blade).

Additionally, the flow passage area reaches the maximum between the position $P_1$ and the position $P_2$.

In FIG. 5, at a position $P_3$, a second maximum point is provided applied and a load is applied to a fluid also at the center in the flow direction.

In FIG. 5, at a position $P_4$, a load is made small so that then outlet satisfies structural restrictions.

Additionally, by using the load on the shroud side of the blade 12 as an after-load, that is, by making the blade angle gradually small to raise the load in order to apply the load to the backward side in the flow direction, it is also possible to reduce the movement of the secondary flow from a shroud pressure surface to a negative pressure surface.

It is also possible to smoothly change a flow on the shroud side of the blade 12.

By providing the maximum points at the positions $P_1$ and $P_3$ and the minimum point at the position $P_2$ in the distribution of the blade angle β on the hub side of the blade 12, a portion where the flow change becomes steep appears. However, the influence of the above portion can be made as small as possible.

Therefore, in the present embodiment, the impeller 1 with a high lift and high efficiency can be realized.

Moreover, according to the rotating machine provided with the impeller 1 related to the present embodiment, the impeller 1 that makes high efficiency and a high lift compatible with each other is included. Since the efficiency of the rotating machine is further enhanced, it is possible to further obtain a lift.

Although the embodiment of the invention has been described above in detail with reference to the drawings, the respective components, combinations thereof, or the like in the embodiment are mere examples. Additions, omissions, substitutions, and other modifications of the components can be made without departing from the spirit of the invention. Additionally, the invention is not limited by the embodiment, and is limited only by the scope of the Claims.

In the present embodiment, the blade 12 used for the impeller 1 of the centrifugal compressor 10 serving as the rotating machine has been described. However, the invention is not limited to this. For example, the blade 12 may be used for an impeller of a turbo compressor, an impeller of a water wheel or a gas turbine, or the like.

Additionally, in the present embodiment, a closed impeller including the cover 13 has been described as an example. However, the invention may be applied to a so-called open type impeller 1 (open impeller) in which the tip 12*a* side of the blade 12 is covered with the shroud surface of the casing 2.

INDUSTRIAL APPLICABILITY

According to the above impeller and the above rotating machine, the compatibility between high lift and high efficiency can be achieved.

REFERENCE SIGNS LIST

O: AXIS
F: FLUID
R: ROTATIONAL DIRECTION
1: IMPELLER
3: ROTATING SHAFT
10: CENTRIFUGAL COMPRESSOR
11: DISC
12: BLADE
12*b*: HUB
A: GRADUAL INCREASE REGION
B: GRADUAL DECREASE REGION
C: PARTIAL GRADUAL DECREASE REGION
D: PARTIAL GRADUAL INCREASE REGION
$P_1$: POSITION OF FIRST MAXIMUM POINT
$P_2$: POSITION OF MINIMUM POINT
$P_3$: POSITION OF SECOND MAXIMUM POINT
CL: CENTER CURVE LINE
PL: PROJECTION CURVE LINE
TL: TANGENT LINE
Tp: TANGENT POINT
IL: IMAGINARY LINE
β: BLADE ANGLE ON HUB SIDE

The invention claimed is:

1. An impeller comprising:

a disc that is supported by a rotating shaft and rotates about an axis of the rotating shaft; and a plurality of blades that are provided to lie substantially in a radial direction on the disc, wherein a flow passage is formed between the blades, and a fluid is delivered radially outward from a rotation center along each of the blades by the rotation of the disc, wherein, in a case where an angle formed on a backward side in a rotational direction of the disc and an outer peripheral side of the disc among angles formed between a tangent line to a projection curve line obtained by projecting a center curve line of the thickness of the blade onto the disc from the direction of the axis of the rotating shaft and an imaginary line orthogonal to a straight line connecting a tangent point between the projection curve line and the tangent line is defined as a blade angle, the blade angle of the blade has a predetermined increase region and a decrease region from the center towards the outside, and a partial decrease region having a smaller blade angle decrease amount than the blade angle increase amount of the increase region is provided at the center of an inflection region between the increase region and the decrease region, the blade angle of the blade is a blade angle on a hub side of the blade, wherein, in the blade, in a case where the flow-direction position of a leading edge that is an inlet side into which a fluid flows is 0%, and the flow-direction position of a trailing edge that is an outlet side from which the fluid flows out is 100%, the partial decrease region is formed within a range of 20% or more and 50% or less.

2. The impeller according to claim 1, wherein a partial increase region is provided between the partial decrease region and the decrease region.

3. A rotating machine comprising:

a rotating shaft that extends along an axis; and the impeller according to claim 1 is supported by the rotating shaft, rotates around the axis together with the rotating shaft, and delivers a fluid radially outward from a rotation center by the rotation thereof.

* * * * *